United States Patent [19]

Franklin

[11] 3,979,601

[45] Sept. 7, 1976

[54] COMBINATION DIMMER AND TIMER SWITCH MECHANISM

[76] Inventor: Robert C. Franklin, 914 Bicknell Road, Los Gatos, Calif. 95030

[22] Filed: Feb. 10, 1975

[21] Appl. No.: 548,876

[52] U.S. Cl. ..... 307/141; 315/194; 200/330

[51] Int. Cl.[2] ..... H01H 7/00

[58] Field of Search ..... 307/141, 141.4, 141.8; 315/360, DIG. 4, 194; 200/330, 4; 322/23, 22 SC

[56] References Cited

UNITED STATES PATENTS

| | | | |
|---|---|---|---|
| 3,450,941 | 6/1969 | Butts | 315/DIG. 4 |
| 3,603,807 | 9/1971 | Erdmann | 307/141 |
| R26,119 | 12/1966 | Slater | 323/22 SC |

*Primary Examiner*—Robert K. Schaefer
*Assistant Examiner*—M. Ginsburg

[57] ABSTRACT

A combination switch for use in a standard wall receptacle for controlling the range of power supplied to the receptacle and also for turning on and off the power to the receptacle in accordance with a predetermined time sequence.

8 Claims, 6 Drawing Figures

COMBINATION DIMMER AND TIMER SWITCH MECHANISM

BACKGROUND OF THE INVENTION

In present day homes it has been found advantageous to both control the level of power supplied to such devices as lamps through so-called dimmer switches and also to provide timers for turning such devices as lamps on and off in accordance with a present sequence. The timed turning on and off of the power may be to regulate electrical appliances, or for the purpose of giving the appearance that the home is occupied when in fact the occupants are away. Dimmer switches are now supplied which can be incorporated into the standard wall receptacle for permitting the manual interruption of or regulation of the power level to the devices controlled by the switch.

However, to provide a timed sequence for lamps and other such devices, separate timers are provided which can be plugged into a convenience outlet with the appliance then being plugged into the timer. These timers typically are housed in an attractive plastic housing containing a timing motor, reduction gears, load switch and appropriate time interval setting devices. Normally such timers provide only one turn-on interval during a twenty-four hour period.

It is the primary object of this invention to provide a combined switch mechanism incorporating both a dimmer control and a timer switch which can be installed in a standard switch wall box. It is a further object of this invention to provide a combination dimmer control and timer switch mechanism which can be easily connected into existing house wiring because electrical connections need only be made with one conductor of the circuit being controlled.

SUMMARY OF THE INVENTION

A combination switch mechanism including main input and output terminals, a dimmer control including power input and output terminals connected between one of the main terminals and the lamp and including a regulating mechanism for adjusting the magnitude of power flow between the main terminals, and a timer circit powered by the voltage drop across the dimmer control and including an actuating means for sequentially interrupting the regulating mechanism of the dimmer control.

DESCRIPTION OF THE INVENTION

Figure 1A:
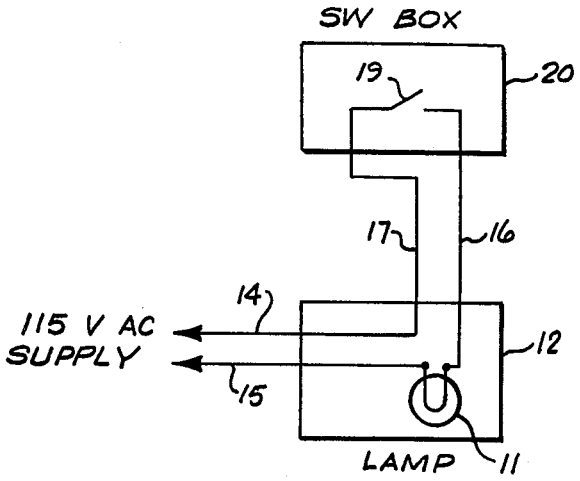
Fig. 1a PRIOR ART
FIG. 1*a* shows a typical prior art wiring circuit for controlling the power to a lamp.

A standard wiring circuit is shown in FIG. 1*a* for turning on and off a lamp 11. The lamp can be, for instance, mounted in the ceiling of one room such as the kitchen in an electrical box 12 fixed in the ceiling. In the normal manner of wiring such a lamp, the two wires 14 and 15 are connected to the standard house circuit and brought into the electrical box 12. From the box the pair of wires 16 and 17, preferably connected to the hot or higher potential line 14, are strung in the wall to a wall switch 19 mounted in a standard electrical box 20. Thus with the turning on and off of the switch 19, the hot line is interrupted thereby turning on and off the power to the lamp 11. As shown in the example of the usual installation, only the hot wire is brought to the switch box and seldom are both wires — that is both the hot and common wires — brought to the switch box directly unless the convenience of installing the wiring system dictates such action.

Figure 1B:
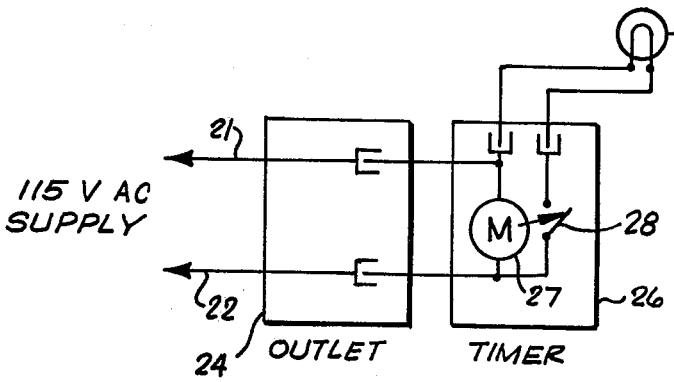
Fig. 1b PRIOR ART
FIG. 1*b* shows a typical prior art wiring circuit for connecting a timer to a lamp.

In FIG. 1*b* is shown a typical prior art timing circuit wherein the common wire 21 and hot wire 22 are brought into an electrical wall box 24. Such a convenience outlet is usually located near floor level such that a lamp 25 can be plugged in. An additional on-off switch not shown in the drawing may be included at the lamp itself. However, if it is desired to automatically time the on-off sequence of the lamp as previously discussed, a timer 26 is first plugged into the outlet and the lamp is in turn plugged into the timer. The timer usually includes a motor 27 which through suitable gearing and actuating mechanisms will open and close a switch 28. Usually such timers operate on a 24-hour basis with one turn-on and turn-off sequence being provided during that period. Thus it can be seen that such a timer is plugged into the circuit between the lamp and the outlet. Of course an additional manual on-off switch might be connected in the hot wire 22 of the supply circuit if desired.

In accordance with the present invention there is provided a combination dimmer and timer circuit mechanism for enabling the regulation of both the power level and the timed sequence for turning an appliance on and off as desired. Such a mechanism is made to be installed in a standard electrical wall box.

Figure 2:
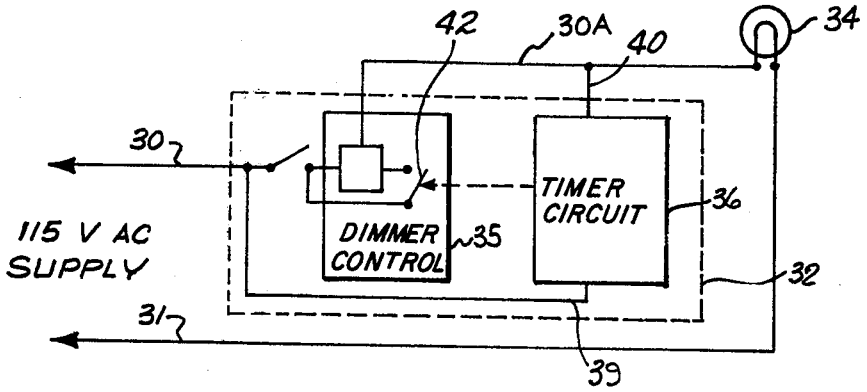
FIG. 2 is a block diagram of the subject invention.

As shown in FIG. 2 there is series connected between an electrical supply hot line 30 and a lamp 34, the subject switching apparatus 32 for controlling power to an electrical appliance such as the electrical lamp 34. The switch 32 includes a dimmer control 35 and a timer circuit 36. It is particularly important to note that this switching apparatus 32 is connected only in the hot wire circuit and therefore can be connected in a standard preexisting wall box whether or not both wires of the circuit are brought into the box. The dimmer control 35 can be manually adjusted to regulate the level of power delivered to the lamp 34. In addition, the apparatus includes an on-off switch 42 which is controlled by the timer circuit 36. It is of particular importance that the electrical power for the timer circuit is derived only from the voltage drop across the dimmer control 35 which power is supplied through the conductors 39 and 40 connected respectively to the conductors 30 and 30A. Thus the timer circuit is supplied power in parallel with the dimmer control by making use of the voltage drop thereacross.

Figure 3:
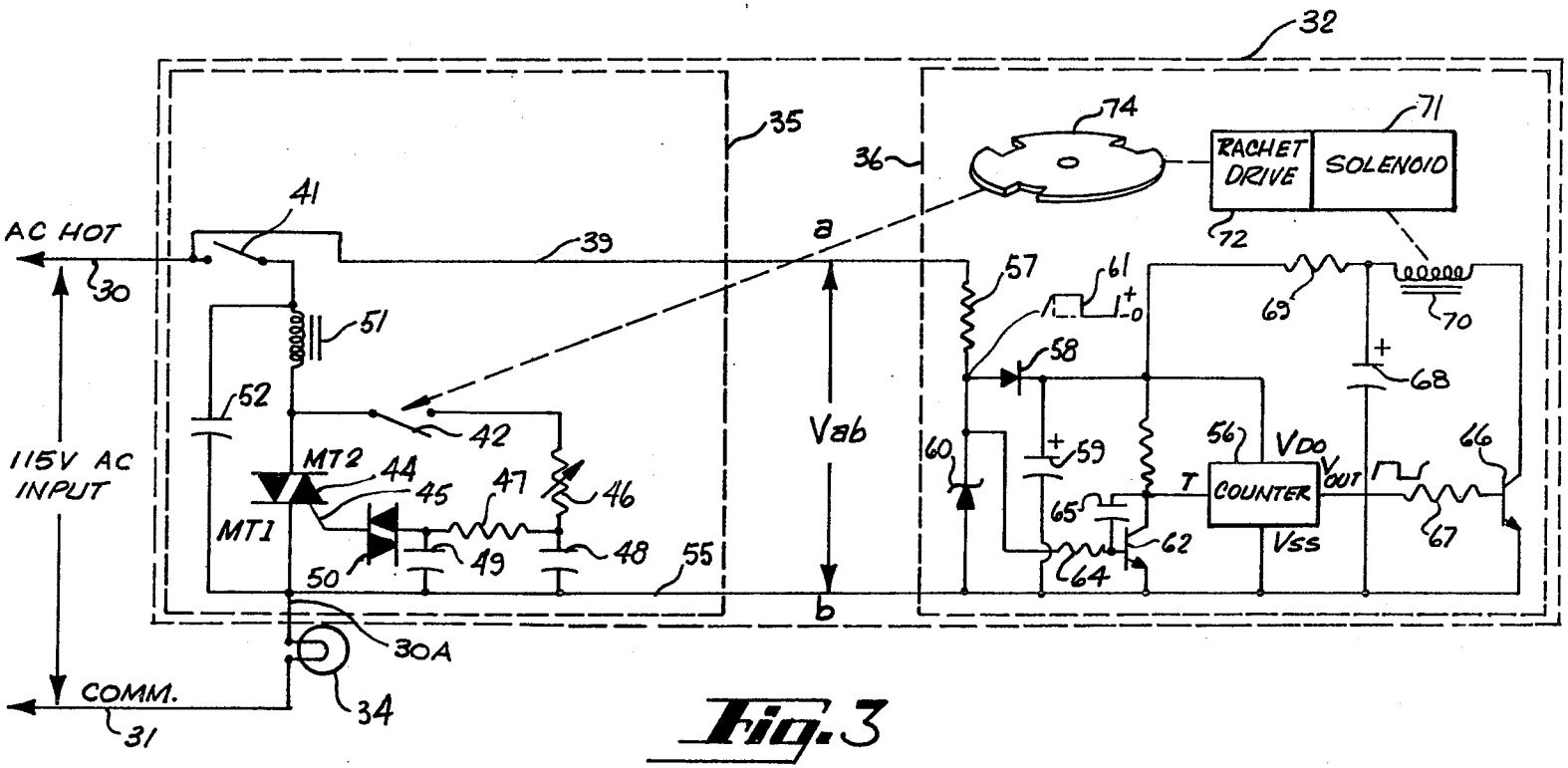
FIG. 3 is a circuit diagram of the subject invention.

In FIG. 3 there is shown a schematic diagram of the subject switch mechanism for regulating power to a lamp 34. The load can be any suitable electrical appliance or device. As illustrated the hot or high potential conductor 30 and the common wire 31 lead from a 115 volt a.c. supply (not shown). The invention is incorporated in the housing illustrated by the dotted line and is connected only in the circuit of the single high potential line. Leading from the invention is the conductor 30A connecting with the lamp or other load. The switching mechanism 32 will both control the magnitude of power supplied to the lamp and also provide for turning the lamp on and off according to a timed sequence and at the power level selected. Thus as described before, the switching mechanism includes a dimmer control 35 and a timer circuit 36.

To describe the operation of the circuit, the dimmer control 35 comprises a typical triac-controlled dimmer circuit the complete description of which may be found with reference to such texts as the RCA Thyristor, Rectifier and Diac Data Book (1973 edition) Application Notes - AN-3697 and AN-3778. While this embodiment of the invention includes such a dimmer control it should be understood that the control could take other forms also.

The dimmer circuit includes a primary on-off switch 41 and a secondary on-off switch 42. The switch 42 is shown to be mechanically actuated but can also be of other types, i.e. photoelectric or magnetic. Assuming the switch 42 is closed and the switch 41 is thereafter closed, the circuit serves to control the firing angle of a triac 44 by changing the phase of a trigger pulse supplied to the gate 45. For this purpose the firing circuit includes a variable resistor 46, a fixed resistor 47, capacitors 48 and 49 and a diac 50.

The operation of such controls is well-known but generally by adjustment of the rate of charge on the capacitors 48 and 49, the firing angle of the diac 50, and in turn the firing of the triac 44, is regulated. With the closing of the switches 41 and 42, the setting of the resistor 46 regulates the charging rate of the capacitors 48 and 49. When these capacitors reach a voltage equal to the trigger voltage of the diac 50 the diac enters a negative resistance operating mode allowing the capacitor 49 to discharge into the gate 45 of the triac 44. Once the triac 44 is triggered, the voltage across the triac drops to near zero and remains so for the remainder of the half cycle. It should also be noted that when the triac is triggered, the remainder of the alternating current half cycle is impressed upon the lamp 34 causing current flow therethrough. This cycle repeats itself for each half cycle of the power input signal. Thus it can be seen that by regulation of the setting of the resistor 46, the firing angle of the a.c. current passing through the dimmer control to the lamp 34 is thereby regulated serving to set the overall power level supplied to the lamp.

It should also be understood that a maximum triac firing angle such as that described herein is generally limited to the trigger voltage of the diac 50. The diac trigger voltage is typically at least 30 volts, therefore at least this voltage drop always appears as $V_{ab}$ between the conductors 39 and 55.

In accordance with another feature of the invention there is provided a timing circuit 36 which functions to regulate energization of the dimmer control by the opening and closing of the switch 42 in accordance with a predetermined timed sequence. This timing circuit will operate on the voltage of 30 volts as provided by the minimum voltage drop across the diac 50 and therefore can be connected in the same circuit as the dimmer control. This enables the timing circuit to be connected only in the circuit of a single conductor of a typical preexisting house wiring circuit leading to a switch where access to the common wire may not be available. Even if the wiring is done in a manner that the common wire passes through the switch instead of the normal hot wire the present circuit will function in the same manner.

The timer circuit 36 preferably utilizes an integrated circuit 56 to count the cycles of the input line frequency (usually 60 Hertz) and produce an output timing signal after a prescribed cycle count has been obtained. Thus the frequency of the line circuit is utilized to provide the input timing signal for the timing circuit. For example, with a 60 Hertz input frequency and a counter which divides the input frequency by 3600, an accurate time interval of 60 seconds will be produced by the counter 56. Such counters are readily available on the market and one example of such a suitable counter is a COS/MOS (complimentary symmetry/-metal oxide semiconductor) integrated circuit. This type of integrated circuit is readily available from many suppliers and is noted for its low power consumption (less than 100 microwatts) and high noise immunity. The counter is provided with the terminals T, $V_{do}$, $V_{ss}$ and $V_{out}$.

For supplying the input timing signal to the counter the 60 Hertz $V_{ab}$ signal is passed through a resistor 57 and a diode 58 for charging a capacitor 59. When this capacitor charge reaches approximately +10 volts, a zener diode 60 initiates conduction because of the positive bias of 10 volts. This zener diode serves to limit the voltage which can be applied to the integrated circuit 56. During the negative half cycle of th signal $V_{ab}$ the diode 58 blocks the discharge of the capacitor 59.

With the zener diode 60 now conducting as a forward biased diode, the voltage drop thereacross is approximately negative 0.7 volts. The resulting waveform 61 illustrated in FIG. 3 is also applied to the base of a transistor 62 having the emitter and collector thereof connected between the terminals $V_{ss}$ and T of the counter. A resistor 64 limits the current applied to the transistor 62. During the positive portion of the waveform 61, the transistor 62 is caused to saturate and be in a conductive mode resulting in the waveform at the collector of the transistor being applied at the terminal T of the counter. A capacitor 65 filters out any unwanted high frequency interference which might cause a false triggering of the counter.

During the time the $V_{out}$ of the counter 56 is at zero volts, a transistor 66 connected with its base receiving the output signal from the counter through a resistor 67 is turned off. During this period a capacitor 68 is charged slowly by current flow through a resistor 69 connected to receive current from the diode 58. The capacitor 68 will be charged to a voltage approximating the voltage across the capacitor 59. In the example illustrated, the time allowed for the capacitor 68 to charge is approximately ½ minute. Thus very little current is required to pass through the resistor 69 in order to charge the capacitor 68.

Such low power consumption for a timing circuit is important since at the time of the maximum triac 44 firing angle there is very little voltage $V_{ab}$ available to power the timing circuit. By maintaining the resistor 57 at a high value, such as 47,000 ohms, a high current flow is prevented which might be physically dangerous because of resulting current flow through the timing circuit 36 and into the lamp 34 through the common connection. For instance, the size of the resistor 57 preferably is selected to allow approximately two milliamps (rms) during the highest setting of the timer circuit for the maximum $V_{ab}$ signal.

When the output voltage of the counter 56 becomes positive, the resulting current flow through the resistor 67 forward biases the transistor 66 thereby causing the transistor to conduct. At this time the capacitor 68 discharges through a solenoid coil 70 causing an associated solenoid 71 to be actuated. As will be described later, this solenoid moves a ratchet drive mechanism 72 which in turn rotates a time programming disc 74 one increment. The disc 74 is configured such that when the switch 42 aligns with one of the notches the switch is closed and when it does not align with one of the notches, the switch is opened. Therefore by controlling the rotation and configuration of the disc 74 the time intervals during which the switch 42 is closed and opened are regulated.

If the switch 41 is closed and the switch 42 is opened as a result of its contact with the outer radius of the disc 74 the triac 44 will be maintained in the non-conductive mode thus maintaining the lamp 34 in the off condition. With the rotation of the disc 74 until a notch aligns with the switch 42 such that the switch closes, the dimmer circuit functions in the manner previously described and so long as that notch aligns with the switch 42, the lamp 34 will be turned on at an energy level determined by the setting of the dimmer control, which is actually regulated by the resistive value of the variable resistor 46.

In accordance with another feature of the invention the previously described switch mechanism is incorporated in a switching apparatus so that it can be installed in a standard wall switch box and connected in preexisting wiring. For this purpose, the mechanism shown in FIGS. 4*a* and 4*b* is supplied.

Figure 4A:
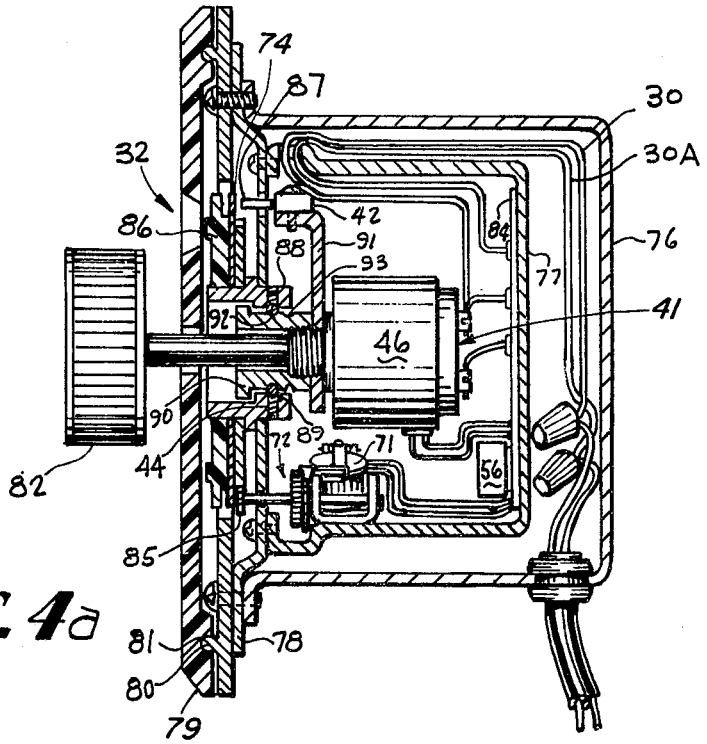
FIG. 4*a* is a cross-sectional view of the switch mechanism incorporating the subject invention.
Figure 4B:
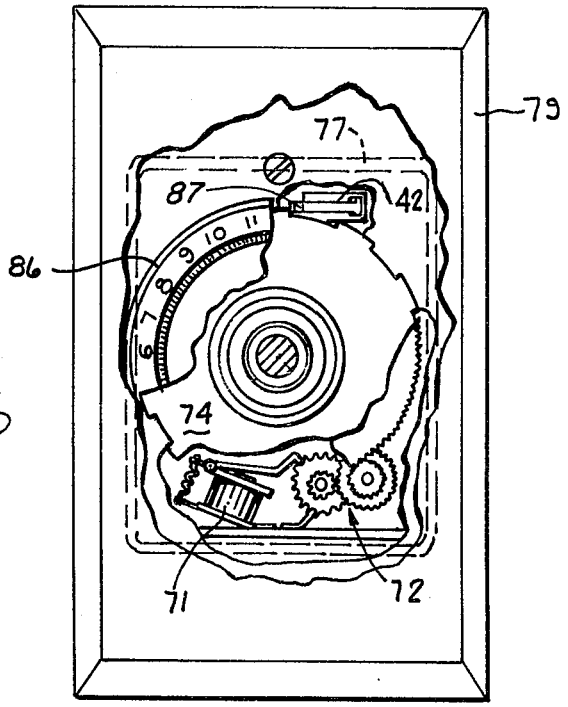
FIG. 4*b* is a front plain view, partially cut away, showing the switch mechanism of FIG. 4*a*.

In FIG. 4*a* is shown a standard electrical wall box 76 in which the switch mechanism 32 is mounted. Conductors 30 and 30A lead into the box in the usual manner of wiring shown in FIG. 1*a*. This switch mechanism permits the turning on and off or interruption of the circuit through these conductors as well as regulation of the power or current level through the conductors as described relative to the circuit diagram in FIG. 3. The switching apparatus is enclosed in a housing 77 having a front cover 78. A front plate 79 is snapped into place over male fittings 80 which are press-fit into a recess 81 in the cover. The apparatus functions such that rotation of a knob 82 permits the setting of the dimmer control in a manner to be described later while pushing on the knob will alternately turn on and off the switch 41 previously described. Pulling on the knob also causes the actuator 87 to contact the disc 74 for timing the opening and closing of the switch 42 as will be explained.

The integrated circuit counter 56 with the associated circuitry of the timer circuit 36 is mounted on a printed circuit board 84 at the inside back of the housing 77. Leading from the housing are the conductors 30 and 30A which are connected to wires leading from the lamp passing into the bottom of the electrical outlet box.

The timer circuit is connected to be energized by the voltage drop across the dimmer control. The integrated circuit counter 56 serves to energize the solenoid 71 through the conductors leading therefrom. The solenoid 71 in turn rotates the ratchet mechanism 72 including the timing gear 85 via the ratchet and gear assembly 72. As the timing gear 85 rotates the programming disc 74 is rotated in unison with a time indicator wheel 86. Both the disc and the time indicating wheel are mounted for rotation about the collar 88 supporting with a sleeve 90 fixed to the rheostat 46 the ball bearing 89. The switch 42 is mounted to bracket 91 which in turn is attached to rheostat 46.

By pulling on the knob 82 the actuator 87 of the switch 42 is brought into proximity with programming disc 74. By pushing on the knob 82, the switch 42 is disengaged permanently to prevent the timed actuation of the dimmer control. This programming disc has notches therein as illustrated in FIG. 3 and when one of the notches in the outer edge aligns with the switch 42 the switch actuator 87 is not actuated or moved thereby permitting this switch 42 to close. However, by pushing on the knob 82, the switch actuator 87 and switch are moved away from the programming disc such that the switch 42 is never opened thereby energizing the dimmer control permanently. Thus the switch 42 is shown in FIG. 4*a* in the electrically closed position for purposes of illustration. A pair of raceways 92 and 93 permit the axial movement of the knob and shaft assembly plus the rheostat 46 and switch 42. By the compression of the springs 44 biasing the bearings 89 towards the raceways in the detent collar 90 the knob can be moved to either the "in" (timer circuit inactivated) or "out" position (timer circuit activated) with the bearings riding in the aligned raceway tending to hold the shaft assembly in that position while permitting rotation of the assembly to set the dimmer control.

To initiate the interval timer operation, the knob 82 is pressed and released to turn on the push on push off switch 41 and then rotated for adjusting the variable resistor 46 which in turn adjusts the brilliance of the lamp 34 as heretofore described. Thereafter the knob 82 is pulled causing the detent collar 90 to move to the left in FIG. 4*a*. As explained, the spring-held ball bearings 89 hold the detent collar in the desired position to which it is moved. With the detent collar in the far left position (FIG. 4*a*) the actuator for the switch 42 now engages the programming disc 74 and as this disc rotates, the lamp will be turned on and off as the cutaway sections of the disc alternately align with and disalign with the switch actuator respectively. The timing intervals for turning the lamp on and off are adjusted by suitably cutting the programming disc notches.

As can be seen the present switch can be mounted in a standard electrical wall box and will serve both to dim, turn on and off and program the energization of the lamp or other suitable electrical device connected to receive power through the switch mechanism. The timer circuit is energized at all times therefore is always properly sequenced with the time of day such that with the pulling out of the knob 82 the timer will always be at its proper setting relative to turning on and off the switch 42 at the proper time period.

The invention claimed is:

1. A combination for controlling power flow from an electrical power source through an electrical circuit to an electrical powered device, said combination comprising:

a dimmer control connected in the circuit for regulating the magnitude of power flow to the device;

a secondary on-off switch for interrupting power flow from the dimmer control to the device;

an electrical timer circuit with means for actuating said secondary switch according to a predetermined timed sequence, said electrical timer circuit including input power terminals connected across said dimmer control for utilization of the voltage drop thereacross for energizing the electrical timer circuit.

2. The combination as defined in claim 1 including a primary on-off switch connected to interrupt the electrical circuit between the source and the electrical powered device.

3. The combination as defined in claim 2 wherein said primary on-off switch is connected to inactivate said dimmer control.

4. The combination as defined in claim 3 wherein said primary switch disables operation of said secondary switch while said electrical timer circuit remains energized.

5. A combination switch mechanism comprising:

main input and output terminals for receiving an alternating current input signal;

a dimmer control including power input and output terminals for connection in series between one A.C. supply input wire and an appropriate electrical load, respectively, and including a regulating mechanism for adjusting the magnitude of power flow from the main input to the output terminals between the ranges of a maximum power setting to a minimum power setting, said maximum power setting including a minimum voltage drop across said dimmer control;

a primary on-off switch connected for interrupting the flow of power from the input to the output terminal of said dimmer control when in the off position and permitting power flow between said terminals and through the dimmer control when in the on position;

a timer mechanism including an electrical timing circuit, said timer mechanism being connected and programmable for interrupting power flow between the input and output terminals of said dimmer control in accordance with a predetermined timed sequence, said timer mechanism including a pair of power input terminals, one connected to each terminal of the dimmer control and energized by the voltage drop across the dimmer control.

6. A combination switch mechanism as defined in claim 5 including a main control shaft which can be rotated and moved longitudinally, and means connected with the shaft to adjust said regulating mechanism to set the dimmer control when the shaft is rotated.

7. A combination switch mechanism as defined in claim 6 including means connecting said main control shaft and said primary on-off switch whereby said switch is alternately moved between the on and off positions with successive press and release movements of the shaft in a longitudinal direction.

8. A combination switch mechanism as defined in claim 7 wherein said timer mechanism includes a frequency counter connected to be energized from the main input terminals for detecting the number of cycles of said input signal and generating a timing signal responsive thereto, and means to actuate a secondary switch in response to said timing signal.

* * * * *